United States Patent [19]

Duerichen

[11] Patent Number: 4,677,965

[45] Date of Patent: Jul. 7, 1987

[54] WOOD OR COAL BURNING HEATER

[76] Inventor: Johann G. Duerichen, P.O. Box 3637, Smithers British Columbia, Canada, V0J 2N0

[21] Appl. No.: 889,912

[22] Filed: Jul. 28, 1986

[51] Int. Cl.[4] ..... F24B 5/00

[52] U.S. Cl. ..... 126/76; 126/77; 126/289; 126/83

[58] Field of Search ..... 126/60, 74–76, 126/77, 80, 83, 103, 112, 69, 289, 64, 65, 290, 292

[56] References Cited

U.S. PATENT DOCUMENTS

| | | | |
|---|---|---|---|
| 319,870 | 6/1885 | Weston | 126/76 |
| 327,650 | 10/1885 | Boyd | 126/76 |
| 998,800 | 7/1911 | Quigley | 126/76 |
| 2,101,509 | 12/1937 | Rasanen | 126/75 |
| 4,194,487 | 3/1980 | Cadwallader | 126/76 |
| 4,377,153 | 3/1983 | Flagg | 126/77 |
| 4,461,273 | 7/1984 | Barker et al. | 126/83 |

FOREIGN PATENT DOCUMENTS

| | | | |
|---|---|---|---|
| 900982 | 7/1945 | France | 126/77 |
| 65033 | 6/1939 | Norway | 126/76 |

*Primary Examiner*—James C. Yeung

*Attorney, Agent, or Firm*—Browdy and Neimark

[57] ABSTRACT

A high-efficiency clean burning heater for the burning of wood or coal is disclosed. The heater has a primary combustion chamber for the burning of solid fuel positioned above a secondary combustion chamber for the burning of combustible gases and pollutants which pass downwardly from the primary combustion chamber. Separate air supplies are provided for the two combustion chambers and the supply of air to the primary combustion chamber is governed by a damper plate to control the burn rate.

8 Claims, 7 Drawing Figures

WOOD OR COAL BURNING HEATER

FIELD OF THE INVENTION

The present invention relates to a heater for the burning of wood or coal, and particularly to a high-efficiency clean burning heater having a controlled rate of combustion providing extended clean burning even in the lower temperature ranges.

BACKGROUND OF THE INVENTION

The use of solid fuel such as wood or coal in place of oil is increasingly popular in view of the high cost and possible scarcity of oil, and substantial research has been conducted to provide heaters or furnaces of the closed controlled-combustion type to provide for maximum efficiency in heat extraction and minimizing heat loss through the chimney. For use as a source of heat for extended periods of time without the nuisance of repeated loadings these known heaters or furnaces are of the closed controlled-combustion type wherein the degree of combustion is governed by controlling the air entering the heater. Such heaters and furnaces are predominantly used at a level less than 50% of maximum burn and it is known that at such lower temperatures much of the fuel in the form of combustible gases and pollutants flow up the chimney where deposits of creosote present the danger of fire and the ejection of these unburned gases and pollutants is damaging to the environment.

Increasingly stringent clean air laws are presently being proposed to limit the pollutant discharge from domestic solid fuel burning heaters and furnaces and the purpose of the present invention is not only to provide a high efficiency heater for the burning of wood or coal, but also to reduce the pollutants and combustible gases expelled from the heater.

To applicant's knowledge, the clean burn heaters presently on the market and which do not include expensive catalyst combustors to further combust and clean the smoke prior to discharge are effective in pollution control only if operated at about 50% and above the maximum burn, and are ineffective in this regard at lower burn rates.

SUMMARY OF THE INVENTION

The present invention presents an advance over these known clean-burn heaters by providing a heater assembly of high efficiency and which does not require a catalyst combustor and which is capable of providing clean burn characteristics at a much lower burn rate than conventional heaters and in the order of about 25% of maximum burn.

These features and advantages are achieved by the present heater which includes a primary combustion chamber for the controlled burning of a solid fuel positioned above a secondary combustion chamber for the subsequent combustion of combustible gases and pollutants which pass downwardly from the primary combustion chamber. An independent air supply is provided for each of the combustion chambers and air flowing to the primary combustion chamber is controlled to govern the rate of burn. A separate air supply is provided in the secondary combustion chamber and this air upon contact with the combustible gases and pollutants passing downwardly from the primary combustion chamber to cause further or secondary combustion to cleanse the smoke and gas of pollutants prior to discharge.

Smoke and exhaust gases leaving the secondary combustion chamber pass first rearwardly and then upwardly along the back of the heater and then forwardly beneath the top surface of the heater prior to discharge to provide increased heat exchange contact between surfaces of the heater and the exhaust smoke and gases. These and other features and advantages of the present heater assembly will become apparent from the following description in association with the accompanying drawings.

BRIEF DESCRIPTION OF THE ACCOMPANYING DRAWINGS

DETAILED DESCRIPTION OF ACCOMPANYING DRAWINGS

Figure 1:
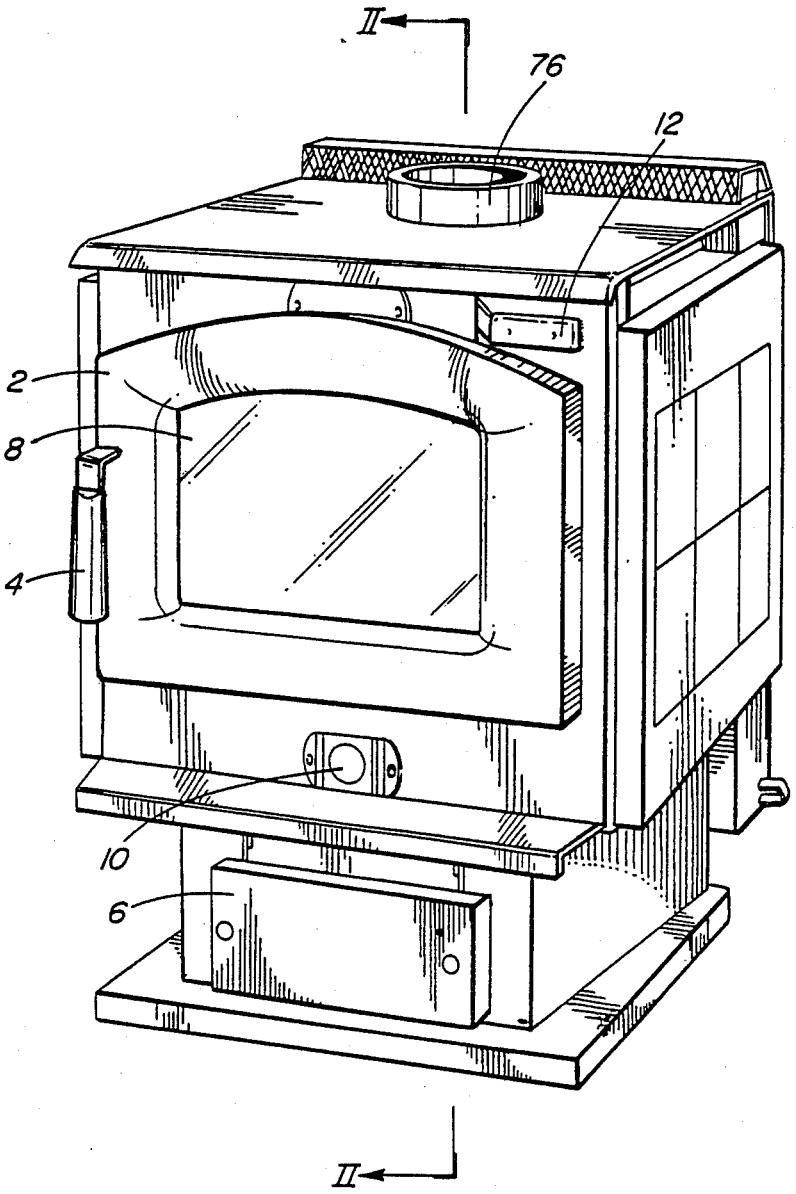
FIG. 1 is a perspective view of a wood/coal heater incorporating the features of the present invention.

The accompanying drawings which illustrate the features and advantages of the present invention will now be described in detail and wherein like reference numerals refer to like parts.

FIG. 1 illustrates the outward appearance of a heater embodying the present features and which has a door 2 with handle 4 for the introduction of solid fuel and a lower air-tight drawer 6 for the removal of ashes resulting from combustion. The door may be provided with a central transparent viewing portion 8 of double pane ceramic glass through which the fire within the heater is visible, and a viewing port 10 also of ceramic glass may be provided for the viewing of burning within the secondary combustion chamber of the heater as will be described in more detail below.

The heater of FIG. 1 is also provided with a smoke control handle 12, the purpose of which will also be discussed in more detail below.

It will of course be appreciated that the outward appearance of the heater as shown in FIG. 1 is for purposes of illustration only, and other outer designs of the heater are possible.

Figure 2:
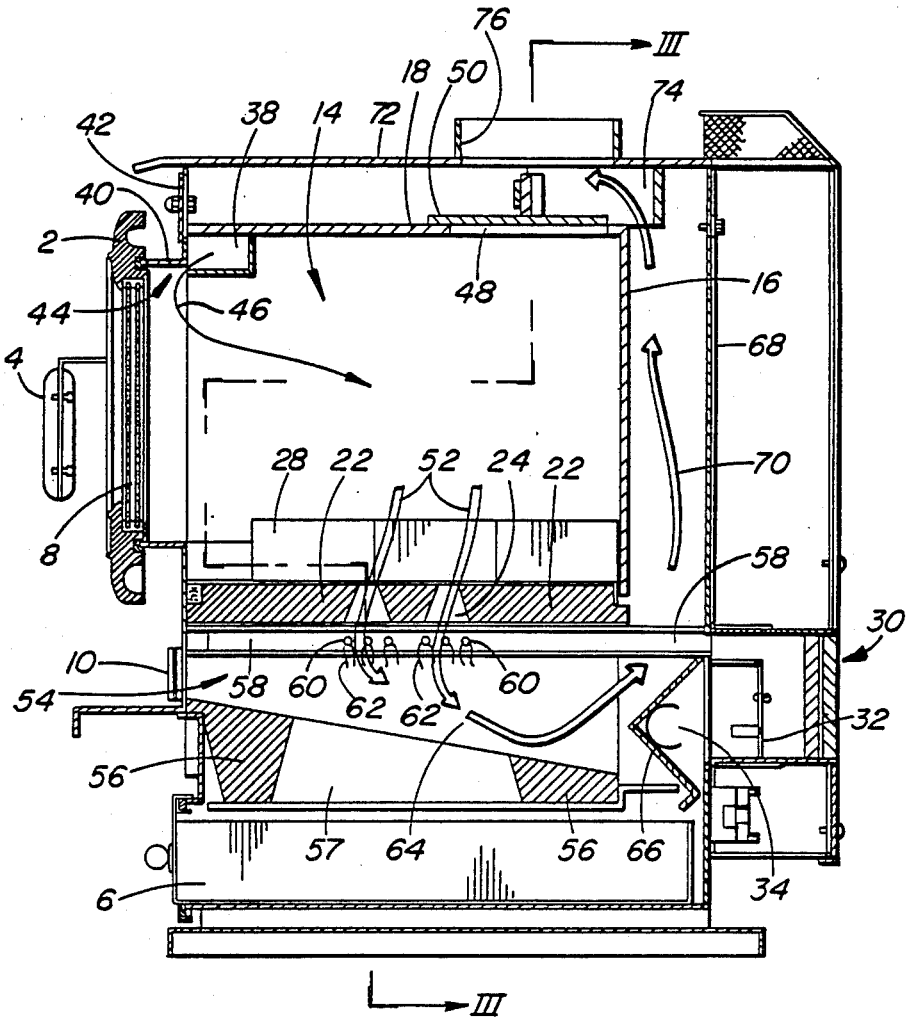
FIG. 2 is a side sectional view taken along line II—II of FIG. 1.

FIG. 2 which is a sectional view taken along line II—II of FIG. 1 shows a primary combustion chamber 14 which is defined by rear wall 16, top wall 18, side walls 20 (see FIG. 3), door 2, and a lower grate 22 formed of high temperature refractory material which is provided with slots 24 (see also FIG. 3) for the downward passage of smoke and exhaust gases into secondary combustion chamber 54 which will be discussed in greater detail below. The lower side surfaces of the primary combustion chamber 14 may also be provided with ceramic refractory material as shown at 28.

Air for the combustion of solid fuel within the primary combustion chamber 14 is introduced through an air intake assembly generally shown at 30 which includes pivoted damper plate 32 which controls the amount of air passing to the primary combustion chamber. Air passing damper 32 enters primary air supply tubes 34 (see also FIG. 3) which extend forwardly on both sides of the heater and open into vertical primary air supply channels 36 (FIG. 3) which extend upwardly along each of the front side corners of the primary combustion chamber and which themselves open into a horizontal primary air supply channel 38 which, as shown in FIG. 2, extends horizontally across the front upper corner of the primary combustion chamber. Also as shown in FIG. 2 a metal frame 40 extends forwardly from the front wall 42 of the combustion chamber 14 and a gap 44 is provided between the horizontal primary air supply channel 38 and the frame 40 and air for combustion of solid fuel within primary combustion chamber 14 is introduced into the chamber 14 through the gap 44 in the direction shown by arrow 46.

This incoming flow of primary air for combustion at an upper point in the primary combustion chamber in addition to feeding the fire also acts to reduce deposits on the inner surface of the window in the door.

During normal extended combustion operation and with a smoke escape port 48 provided in the top wall 18 of chamber 14 closed by plate 50, (the purpose of which will be discussed below) all of the air for combustion within the primary combustion chamber 14 is introduced through gap 44 and smoke and exhaust gases resulting from combustion pass from the chamber 14 downwardly through the fire and through slots 24 in grate 22 as shown by arrows 52 into secondary combustion chamber 54.

The secondary combustion chamber 54 is lined along its bottom and sides with insulating refractory material 56 to maintain a high temperature within the chamber to maximize the combustion of combustible creosote-laden gases flowing downwardly from the primary combustion chamber. One or more slits or separations 57 are provided for the downward discharge of ash into the ash drawer 6.

Fresh air for this secondary combustion is supplied by secondary air supply tube 58 which is positioned immediately beneath grate 22 and extends forwardly from air inlet assembly 30 to the front of the heater and each side of the tube 58 is provided with small openings 60 immediately beneath the slots 24 for the introduction of fresh air into the streams of combustible gases flowing from the primary 14 to the secondary 54 combustion chambers. These hot combustible creosote-laden gases upon mixture with the fresh air supplied through tube 58 ignite the combustible gas flow to extract further heat from the fuel while minimizing creosote and other burnable constituents carried by the gas which is eventually vented to the atmosphere. This burning of the combustible gas in the form of small flames extending from the openings 60 in tube 58 in the secondary combustion chamber 54 can be seen through viewing port 10 and even when the fuel in the primary chamber 14 is reduced to glowing coals the small flames in the secondary chamber continue to burn using all the combustive gases from the fuel as a source of heat.

Smoke leaving the secondary combustion chamber 54 flows rearwardly in the direction of arrows 64 and contacts angled plate 66 behind which are positioned the primary air intake tubes 34 and this arrangement heats the air which is led through tubes 34 to the primary combustion chamber to assist in the combustion process. After passing the angled plate 66 the smoke leaving the secondary combustion chamber passes upwardly in a vertical smoke passage formed between the rear wall 16 of the primary combustion chamber and the rear surface 68 of the heater as shown by arrow 70. This smoke which moves rearwardly and upwardly flows around the air intake tube 58 to heat the incoming air and enhance combustion in the secondary combustion chamber. Upon reaching the top of the heater, the smoke then flows forwardly in a horizontal smoke passage formed between the top wall 18 of the primary combustion chamber and the top surface 72 of the heater and around the end of baffle 74 (see also FIG. 4) before reaching chimney outlet 76. This flow of smoke and exhaust gases across the bottom of the heater, up the back, across the top, and then back to the chimney outlet results in efficient heat exchange and reduced heat loss.

Figure 3:
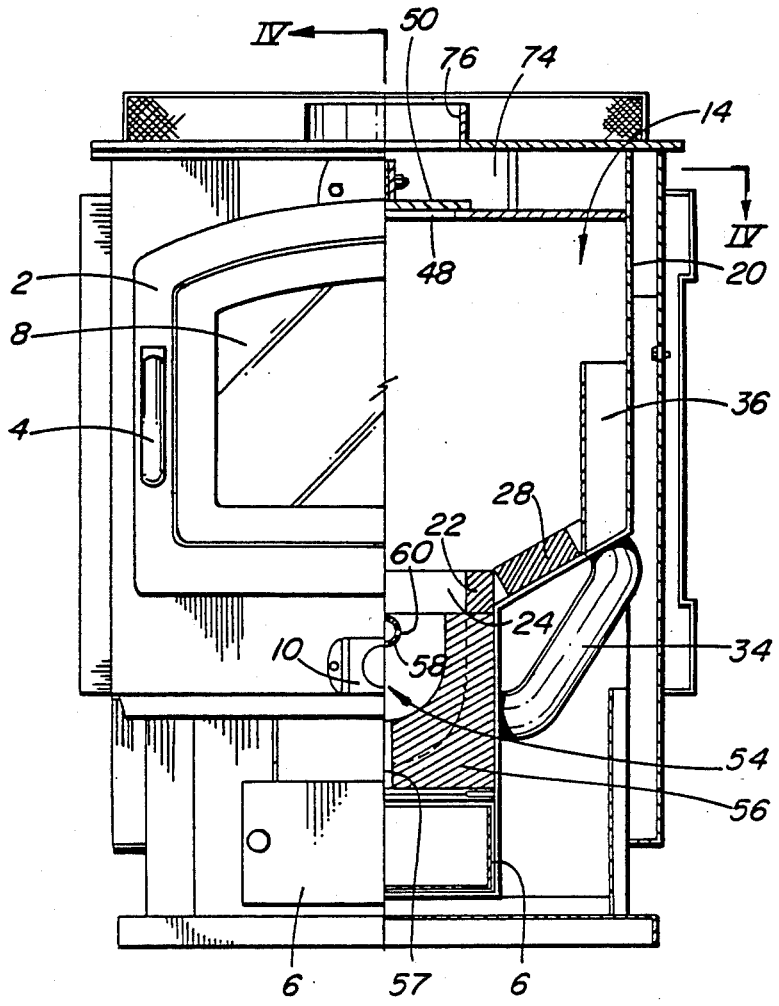
FIG. 3 is a partially sectioned front view with the section being taken along line III—III of FIG. 2.
Figure 4:
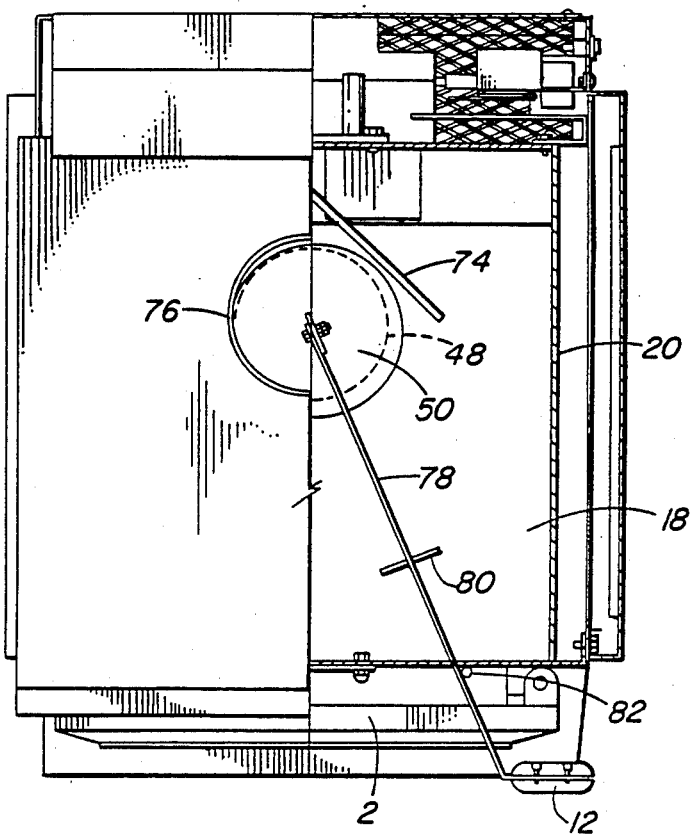
FIG. 4 is a partially sectioned top view with the section being taken along lines IV—IV of FIG. 3.

FIG. 4 is a top view partially in section of the present heater with the section being taken along line IV–IV of FIG. 3. As also shown in FIGS. 2 and 3, the top wall 18 of the primary combustion chamber is provided with a smoke escape port 48 which during normal extended burn operation is closed by plate 50. The plate 50 is simply positioned for sliding movement with respect to the smoke port 48 by means of a rod 78 whic is attached to the plate and which extends forwardly through the front panel 42 of the heater above the door where it is provided with handle 12. The rod passes through guide flange 80 and when the handle is pushed fully inwardly, the plate covers the smoke port 48 whereas forward movement of the handle draws the plate 50 from its covering of the port to permit the escape of smoke from the primary combustion chamber directly to the chimney outlet.

This smoke control is of value when initially starting a fire in the heater or when fuel is added to an existing fire. When the heater is in use, and the fuel is to be added, the opening of the smoke escape port 48 with or before the opening of the front door 2 permits smoke contained in the primary combustion chamber 14 to escape upwardly out the chimney rather than tending to flow outwardly into the room through the open front door.

Additionally, and when a fire is first started, combustion is promoted by opening the smoke escape port somewhat to improve air circulation. Once the fire has started, however, the smoke escape port should be fully closed to obtain maximum efficiency from the heater. To ensure that the smoke escape port is at least substantially closed, the control rod 78 may be provided with a downwardly depending pin 82 (see FIG. 4) which limits the amount of outward movement of rod 78 when the front door 2 is closed.

Figure 5:
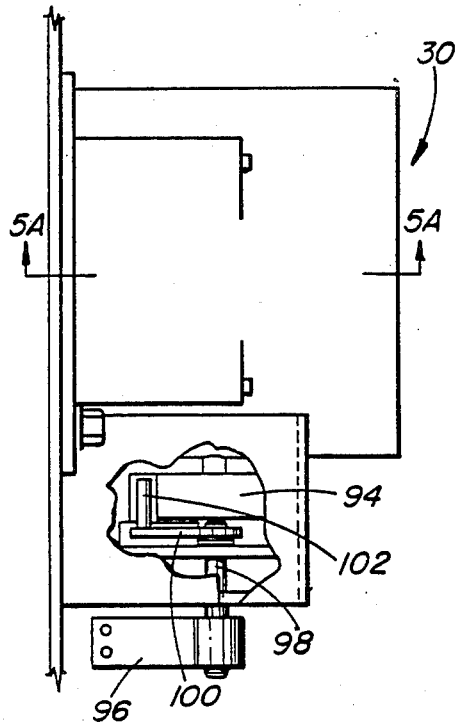
FIG. 5 is an enlarged partially sectioned top view of a bimetallic draft control suitable for use with the present heater.
Figure 5A:
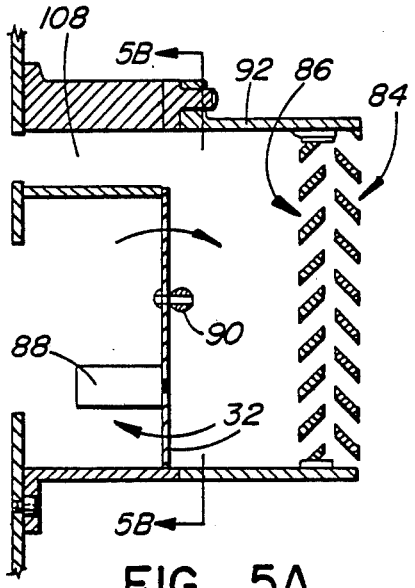
FIG. 5A is a sectional view taken along line A—A of FIG. 5.
Figure 5B:
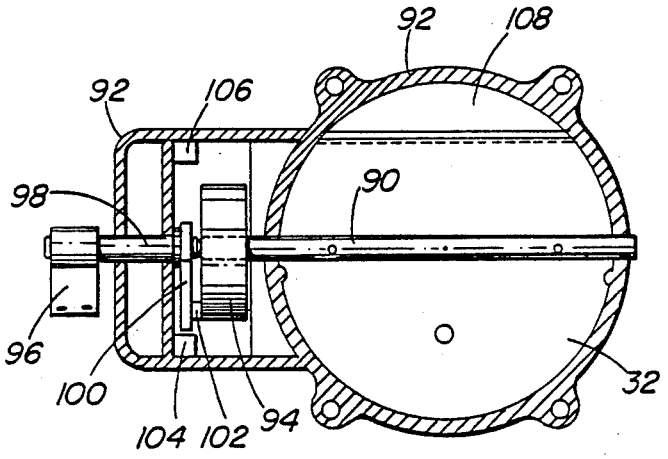
FIG. 5B is a partially sectioned view taken along line B—B of FIG. 5A.

FIGS. 5, 5A, and 5B are enlarged views of the air intake assembly illustrated generally by numeral 30 in FIG. 2. This assembly is preferably a sealed unit which contains a bimetallic draft control which is factory pre-set to ensure against overheating of the heater. To guard against tampering, air flow into the assembly is through sets of oppositely angled louvers 84 and 86 as shown in FIG. 5A to prevent the insertion of a wire or other tool to alter the positioning of the damper plate 32 to permit the entry of excess air into the heater and possibly cause overheating.

The damper plate 32 which is provided with counterweight 88, is mounted on damper rod 98 which is pivotally mounted within casing 92 and one end of the rod carries a coiled temperature-sensitive bimetallic spring 94. Control of the positioning of the damper plate is by control lever 96 which is mounted on rod 98 rotatably carried by the casing and which carries on its inner end an arm 100 having a pin 102 which bears against the coiled bimetal element. The extent of movement of the control lever is governed by stops 104 and 106 as shown in FIG. 5B.

Adjustment of the positioning of the damper plate 32 may be provided by chains or similar (not specifically shown) extending upwardly from the control lever 96. In FIG. 5, the control lever 96 is shown as having two openings for receiving the ends of two such chains. One chain may lead directly to a manual temperature control conveniently provided at the top of the heater or alternatively a chain can lead from the control lever to an electric control motor (not shown) mounted on the heater and which is driven by an electric wall thermostat (not shown) to open or close the damper plate depending upon the desired room temperature. It will be appreciated, however, that the control lever 96 controls the positioning of the damper plate 32 only through the intermediately positioned bimetallic element 94 and overheating of the heater as sensed by the bimetallic element which is positioned in heat sensing relationship with the heater will override the damper control and rotate the damper plate to lessen or stop the amount of incoming primary air to reduce the rate of combustion.

It is only the intake of air leading to the primary combustion chamber 14 that is governed by the damper plate 32 and air flowing to the secondary combustion tube 58 simply flows unobstructed through opening 108 provided in the upper portion of the air intake assembly.

The provision of having air for both the primary and secondary combustion enter the heater through the single air intake assembly 30 provides the additional advantage of enabling fresh air for combustion to be ducted from outside of the building directly to the heater. This is an important feature when the heater is used in well insulated tightly sealed buildings to ensure adequate oxygen supply for proper heater operation and to prevent reduction of the quality of air within the building itself. This direct ducting of fresh air can conveniently be accomplished by manufacturing the air intake 30 with a diameter (for example 5 inches) to readily receive standard diameter ducting available on the market.

I claim:

1. A wood and coal burning heater comprising a housing having a front surface, a rear surface, a bottom surface and a side surface and a top surface having a chimney opening, and a normally closed primary combustion chamber for the combustion of wood and coal within the housing, the combustion chamber having a top wall and a rear wall spaced inwardly from the top and rear surfaces of the housing forming therebetween horizontal and vertical smoke passages respectively, and a door opening in the front surface for access to the primary combustion chamber and a door for tightly closing the door opening, and a secondary combustion chamber positioned below the primary combustion chamber for the burning of combustible smoke, gas and ash passing downwardly from the primary combustion chamber, the secondary combustion chamber being lined along its bottom and sides with insulating refractory material and having a narrow opening in the bottom for the downward discharge of ashes into an air-tight ash drawer, the primary and secondary combustion chambers being separated by a grate of high-temperature ceramic refractory material which is provided with two narrow spaced slots which are aligned in front of rear direction, and an elongate air supply tube positioned immediately below and in parallel alignment with the slots in the grate with the air supply tube having air supply orifices positioned beneath the slots for the discharge of air for secondary combustion, and means for independently introducing air for combustion into the primary and secondary combustion chambers, the air for combustion in the primary combustion chamber being introduced upwardly in the primary combustion chamber and the air for combustion in the secondary combustion chamber being introduced through the air supply tube, whereby smoke and gas produced by combustion in the primary combustion chamber pass downwardly through the slots in the grate into the lined secondary combustion chamber and then rearwardly therein and then upwardly in the vertical smoke passage to the horizontal smoke passage for discharge through the chimney opening.

2. A heater according to claim 1, including a forwardly angled baffle between the top wall and said top surface to direct smoke around the horizontal smoke passage prior to discharge through the chimney opening.

3. A heater according to claim 1, including a smoke escape port in the top wall of the primary combustion chamber, and a cover plate positioned over the smoke escape port and slideably movable to open and close the port, and a rod secured to the plate and extending forwardly through the front surface of the heater with a handle at the forward end to provide manual selective positioning of the cover plate with respect to the smoke escape port.

4. A heater according to claim 1, wherein air for both the primary and secondary combustion chambers enters the heater through an air inlet assembly provided in the rear surface of the heater behind the secondary combustion chamber, air flow to the air supply tube for the secondary combustion chamber being directed through the air inlet assembly, a movable damper plate provided to control the amount of air flowing to the primary combustion chamber which is adjustable to control the rate of combustion in the primary combustion chamber.

5. A heater according to claim 4, wherein a heat sensitive bimetal element is connected to the damper plate to close the damper plate and reduce the flow of air to the primary combustion chamber in the event of overheating of the heater.

6. A heater according to claim 5, wherein the exterior of the air inlet assembly is provided with inner and outer sets of oppositely angled louvres to prevent access to the damper plate.

7. A heater according to claim 6, wherein the exterior of the air inlet assembly is of a diameter to receive standard diameter ducting to enable fresh air for combustion to be supplied directly to the heater from outside the building.

8. A heater according to claim 4, wherein air to the primary combustion chamber flows from the air inlet assembly through primary air supply tubes which extend forwardly on each side of the secondary combustion chamber and upwardly to vertical air supply channels which are formed in the front side corners of the primary combustion chamber and which open into a horizontal air supply channel which extends across the front upper edge of the primary combustion chamber, a gap being provided between the horizontal air supply channel and the upper edge of the door opening to supply air to the primary combustion chamber.

* * * * *